US011118289B2

(12) United States Patent
Tsuchikura et al.

(10) Patent No.: US 11,118,289 B2
(45) Date of Patent: Sep. 14, 2021

(54) FLAME-BLOCKING NONWOVEN FABRIC

(71) Applicant: Toray Industries, Inc., Tokyo (JP)

(72) Inventors: Hiroshi Tsuchikura, Otsu (JP); Keiichi Tonomori, Otsu (JP)

(73) Assignee: Toray Industries, Inc., Tokyo (JP)

( * ) Notice: Subject to any disclaimer, the term of this patent is extended or adjusted under 35 U.S.C. 154(b) by 281 days.

(21) Appl. No.: 15/738,826

(22) PCT Filed: Jun. 28, 2016

(86) PCT No.: PCT/JP2016/069122
§ 371 (c)(1),
(2) Date: Dec. 21, 2017

(87) PCT Pub. No.: WO2017/006807
PCT Pub. Date: Jan. 12, 2017

(65) Prior Publication Data

US 2018/0187351 A1 Jul. 5, 2018

(30) Foreign Application Priority Data

Jul. 3, 2015 (JP) ..... JP2015-134180

(51) Int. Cl.
*D04H 1/42* (2012.01)
*D21H 13/26* (2006.01)
(Continued)

(52) U.S. Cl.
CPC ..... *D04H 1/42* (2013.01); *D04H 1/4326* (2013.01); *D04H 1/54* (2013.01); *D21H 13/10* (2013.01);
(Continued)

(58) Field of Classification Search
CPC ..... D21H 21/24; D21H 15/10; D21H 13/26; D21H 13/10; D04H 1/42; D04H 1/4326; D04H 1/54
USPC ..... 428/920, 921
See application file for complete search history.

(56) References Cited

U.S. PATENT DOCUMENTS 3,855,382 A * 12/1974 Takeya ..... D01F 6/18 264/178 F
4,623,571 A 11/1986 Yamamoto et al.
(Continued)

FOREIGN PATENT DOCUMENTS

JP 61-177235 A 8/1986
JP 2003-129362 A 5/2003
(Continued)

OTHER PUBLICATIONS

Ellis, Bryan Smith, Ray. (2009). Polymers—A Property Database (2nd Edition). Taylor & Francis.*
(Continued)

*Primary Examiner* — Jennifer A Gillett
(74) *Attorney, Agent, or Firm* — DLA Piper LLP (US)

(57) ABSTRACT

A flame-blocking nonwoven fabric has excellent processability and high flame-blocking properties. The flame-blocking nonwoven fabric has a density of 200 kg/m$^3$ or more and includes non-melting fibers A whose high-temperature shrinkage rate is 3% or less and whose Young's modulus multiplied by the cross-sectional area of the fibers is 2.0 N or less, and thermoplastic fibers B whose LOI value is 25 or more as determined according to JIS K 7201-2 (2007).

5 Claims, 1 Drawing Sheet

(51) Int. Cl.

| | |
|---|---|
| ***D21H 13/10*** | (2006.01) |
| ***D21H 21/34*** | (2006.01) |
| ***D04H 1/4326*** | (2012.01) |
| ***D04H 1/54*** | (2012.01) |
| ***D21H 13/20*** | (2006.01) |
| ***D21H 15/10*** | (2006.01) |

(52) U.S. Cl.
CPC ..... *D21H 13/20* (2013.01); *D21H 13/26* (2013.01); *D21H 15/10* (2013.01); *D21H 21/34* (2013.01)

(56) References Cited

U.S. PATENT DOCUMENTS

| | | | | |
|---|---|---|---|---|
| 4,970,111 | A * | 11/1990 | Smith, Jr. | D04H 1/4291 428/369 |
| 5,279,878 | A | 1/1994 | Föttinger et al. | |
| 5,336,556 | A * | 8/1994 | Yoshida | B01D 39/163 156/296 |
| 2002/0182967 | A1 | 12/2002 | Erb, Jr. et al. | |
| 2006/0111000 | A1* | 5/2006 | Bascom | A47C 31/001 442/136 |
| 2008/0145600 | A1* | 6/2008 | Hendren | B31D 3/0292 428/116 |
| 2009/0061275 | A1 | 3/2009 | Ko et al. | |
| 2011/0070420 | A1* | 3/2011 | Lim | B32B 5/26 428/219 |

FOREIGN PATENT DOCUMENTS

| | | | |
|---|---|---|---|
| JP | 2010-513063 | A | 4/2010 |
| JP | 2013-169996 | A | 9/2013 |
| JP | 2014-148113 | A | 8/2014 |
| JP | 2014-228035 | A | 12/2014 |
| RU | 2361973 | C1 | 7/2009 |
| RU | 2454907 | C2 | 7/2012 |
| WO | 2006/022857 | A2 | 3/2006 |
| WO | 2008/076404 | A2 | 6/2008 |
| WO | 2009/055047 | A1 | 4/2009 |

OTHER PUBLICATIONS

McKeen, Laurence W.. (2016). Fluorinated Coatings and Finishes Handbook—The Definitive User's Guide (2nd Edition). Elsevier.*
Toyobo, Heat Chemical Resistant Fibers, PROCON, www.toyobo-global.com/seihin/fb/procon/index, retreived Nov. 12, 2019.*
Pyron, Zoltek Toray Group, retrieved from https://pdf.nauticexpo.com/pdf/zoltec/pyron-brochure/39360-88272.html, Apr. 28, 2020.*
Nametz, R.C., Flame-Retarding Synthetic Textile Fibers, Industrial and Engineering Chemistry, vol. 62 No. 3, Mar. 1970.*
Extended European Search Report dated Jan. 18, 2019, of counterpart European Application No. 16821276.9.
Russian Office Action dated Nov. 30, 2018, of counterpart Russian Application No. 2018103733, including an English translation.

* cited by examiner

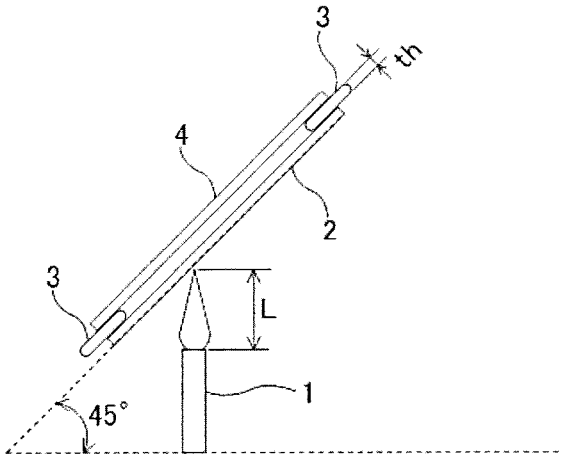
3
th
4
2
3
L
1
45°

FLAME-BLOCKING NONWOVEN FABRIC

TECHNICAL FIELD

This disclosure relates to a nonwoven fabric having excellent flame-blocking properties. The nonwoven fabric is effective in preventing a fire from spreading, and is thus suitable as a wall material, a flooring material, a ceiling material and the like that are required to have flame-retardant properties, in particular, is suitable for use in a closed space such as a vehicle cabin and an aircraft cabin.

BACKGROUND

Nonwoven fabrics of synthetic fibers made from synthetic polymers such as polyamide, polyester and polyolefin, are conventionally used. These fabrics usually have no inherent flame-retardant properties and, therefore, in most cases, require some flame-retardant treatment.

Various methods have been proposed to impart flame-retardant properties to nonwoven fabrics, including, for example, a method involving copolymerization of a polymer with a flame-retardant component, a method involving kneading of a flame-retardant component with a polymer, a method involving attachment of a flame-retardant component to a nonwoven fabric and the like.

For the above purpose, a flame retarder in a liquid form is also used. Also known is a fire-resistant heat-insulating material comprising ceramic fibers and an inorganic binder (JP 2014-228035 A). Further known is a flame-retardant nonwoven fabric comprising a thermoplastic material and a high modulus fiber (JP 2010-513063 A).

A conventional polyester filament nonwoven fabric made from a polymer containing a flame-retardant component as a copolymerization component does not have high flame-retardant performance. Of the above-mentioned methods, the method involving direct attachment of a flame-retardant component to a nonwoven fabric is the most convenient way to impart flame-retardant properties. However, when a flame retarder in a solid form is used as the flame-retardant component, the attached flame retarder easily falls off. Consequently, the fabric has very poor durability although its flame retardancy is excellent. On the other hand, when a flame retarder in a liquid form is used, the flame retarder may ooze out from the fabric and contaminate or be transferred to other objects. To prevent this, the flame retarder is inevitably required to be fixed on the nonwoven fabric or textile with a thermosetting resin. This method, however, involves a complicated process, and the resulting nonwoven fabric may lose most of the original texture resulting in poor flexibility, and may have very poor moldability.

The method of JP 2014-228035 A uses an inorganic binder with high stiffness to produce the fire-resistant material. Due to the high stiffness, when the material is largely deformed in a bending process, the material may develop a crack, which possibly allows entry of flames or possibly results in loss of the shape as a structural member of an article.

The flame-retardant nonwoven fabric of JP 2010-513063 A comprises a high modulus fiber, which in general has a high heat shrinkage rate. Due to the high heat shrinkage rate, when the fabric is exposed to a flame and heated to high temperature, the high modulus fiber shrinks, and the nonwoven fabric develops a crack on the surface that is positioned just above the flame and heated to the highest temperature, and eventually develops a hole. Hence, the fabric lacks flame-blocking performance even though the fabric has flame-retardant properties. It could therefore be helpful to provide a flame-blocking nonwoven fabric having excellent processability and high flame-blocking properties.

SUMMARY

We thus provide:

(1) A flame-blocking nonwoven fabric having a density of 200 kg/m$^3$ or more and comprising non-melting fibers A whose high-temperature shrinkage rate is 3% or less and whose Young's modulus multiplied by the cross-sectional area of the fibers is 2.0 N or less, and thermoplastic fibers B whose LOI value is 25 or more as determined according to JIS K 7201-2 (2007).

(2) The flame-blocking nonwoven fabric according to the above (1), wherein the amount of the non-melting fibers A contained in the fabric is 15 to 70% by weight.

(3) The flame-blocking nonwoven fabric according to the above (1) or (2), comprising 20% by weight or less of fibers C in addition to the non-melting fibers A and the thermoplastic fibers B.

(4) The flame-blocking nonwoven fabric according to any one of the above (1) to (3), wherein the thermoplastic fibers B are fused with the non-melting fibers A.

(5) The flame-blocking nonwoven fabric according to any one of the above (1) to (4), wherein the non-melting fibers A are flame-resistant fibers or meta-aramid fibers.

(6) The flame-blocking nonwoven fabric according to any one of the above (1) to (5), wherein the thermoplastic fibers B are fibers made from a resin selected from the group consisting of an anisotropic melt-phase forming polyester, a flame-retardant poly(alkylene terephthalate), a flame-retardant poly(acrylonitrile-butadiene-styrene), a flame-retardant polysulfone, a poly(ether-ether-ketone), a poly(ether-ketone-ketone), a polyether sulfone, a polyarylate, a polyphenyl sulfone, a polyether imide, a polyamide-imide, and a mixture thereof.

(7) The flame-blocking nonwoven fabric according to any one of the above (1) to (6), wherein the thermoplastic fibers B have a glass transition point of 110° C. or less.

The flame-blocking nonwoven fabric having the above structure has excellent processability and high flame-blocking properties.

BRIEF DESCRIPTION OF THE DRAWING

The FIGURE is a schematic illustration showing a flammability test for assessment of flame-blocking properties.

REFERENCE SIGNS LIST

1 Micro Burner
2 Specimen
3 Spacers
4 Combustible Object

DETAILED DESCRIPTION

We provide a flame-blocking nonwoven fabric having a density of 200 kg/m$^3$ or more and comprising non-melting fibers A whose high-temperature shrinkage rate is 3% or less and whose Young's modulus multiplied by the cross-sectional area of the fibers is 2.0 N or less, and thermoplastic fibers B whose LOI value is 25 or more as determined according to JIS K 7201-2 (2007).

High-Temperature Shrinkage Rate

The high-temperature shrinkage rate herein is a value determined as follows. The fibers used to form the nonwoven fabric are left to stand under standard conditions (20° C., 65% relative humidity) for 12 hours. The initial length L0 of the fibers is measured under a tension of 0.1 cN/dtex. Then, the fibers under no load are exposed to dry heat atmosphere at 290° C. for 30 minutes, and then sufficiently cooled under standard conditions (20° C., 65% relative humidity). The length L1 of the fibers is measured under a tension of 0.1 cN/dtex. From L0 and L1, the high-temperature shrinkage rate is determined by formula (1):

$$\text{High-temperature shrinkage rate (\%)}=[(L0-L1)/L0]\times 100 \quad (1).$$

When a flame approaches the fabric, the thermoplastic fibers are melted by the heat, and the molten thermoplastic fibers spread over the surface of the non-melting fibers (the structural filler) like a thin film. Then, as the temperature of the fabric goes up, both types of fibers are eventually carbonized. During elevation of the temperature, the fabric is less likely to shrink because the high-temperature shrinkage rate of the non-melting fibers is as low as 3% or less. Consequently, the fabric is less likely to develop a hole and can thus block the flame. To allow the fabric to exhibit this function, the high-temperature shrinkage rate is preferably small. However, even without shrinkage, large elongation of the fabric by heat may cause collapse of the fabric structure and development of a hole. Therefore, the high-temperature shrinkage rate is preferably not less than −5%, and more preferably from 0 to 2%.

Young's Modulus and Cross-Sectional Area of Fibers

The Young's modulus of the non-melting fibers A multiplied by the cross-sectional area of the fibers is preferably 2.0 N or less. The fabric comprising the non-melting fibers A having this preferred value has excellent processability in bending, i.e., the fibers are less likely to break and the fabric is less likely to develop a crack. However, if the nonwoven fabric is excessively soft, some problems may arise such as poor runnability of the sheet at the processing stages. Therefore, the Young's modulus of the non-melting fibers A multiplied by the cross-sectional area of the fibers is preferably 0.05 N or more, and more preferably 0.5 to 1.5 N. The Young's modulus multiplied by the cross-sectional area herein is a value calculated from the Young's modulus ($N/m^2$) and the cross-sectional area ($m^2$) according to formula (2):

$$\text{Young's modulus multiplied by cross-sectional area (N)}=(\text{Young's modulus}(N/m^2))\times(\text{cross-sectional area}(m^2)) \quad (2).$$

The cross-sectional area of the non-melting fibers is calculated from the density and the fineness of the non-melting fibers according to formula (3):

$$\text{Cross-sectional area } (m^2) \text{ of non-melting fibers}=\{(\text{fineness (dtex) of non-melting fibers})/(\text{density } (kg/m^3) \text{ of non-melting fibers})\}\times 10^{-7} \quad (3)$$

In formula (3), the density of the non-melting fibers is a value measured by a method based on ASTM D4018-11, and the fineness (dtex) of the non-melting fibers is the mass (g) per 10000 m.

The Young's modulus of the non-melting fibers is calculated by a method based on ASTM D4018-11. The Young's modulus is expressed in $N/m^2$, which is equal to Pa. The cross-sectional area of the non-melting fibers used to multiply the Young's modulus is determined by formula (4):

$$\text{Cross-sectional area}(m^2) \text{ of non-melting fibers}=\{(\text{fineness of non-melting fibers (dtex)})/(\text{density } (kg/m^3) \text{ of non-melting fibers})\}\times 10^{-7} \quad (4).$$

In formula (4), the density of the non-melting fibers is a value measured by a method based on ASTM D4018-11, and the fineness (dtex) of the non-melting fibers is the mass (g) per 10000 m.

LOI Value

The LOI value is the minimum volume percentage of oxygen, in a gas mixture of nitrogen and oxygen, required to sustain combustion of a material. A higher LOI value indicates better flame-retardant properties. The thermoplastic fibers having a LOI value of 25 or more as measured in accordance with JIS K7201-2 (2007) have good flame-retardant properties. Even if the thermoplastic fibers catch a fire from a fire source, the fire immediately goes out once the fire source is moved away. The slightly burnt part typically forms a carbonized film, and the carbonized part can block the spread of the fire. A higher LOI value is preferred, but the LOI value of currently available materials is up to about 65.

Density

The fabric having a density of 200 $kg/m^3$ or more has a densely packed thermoplastic fiber tissue and is thus less likely to develop a hole. An extremely dense tissue tends to develop a crack and, therefore, the density is preferably 1200 $kg/m^3$ or less, and more preferably 400 to 900 $kg/m^3$.

Non-Melting Fibers A

The non-melting fibers A herein refer to fibers that, when exposed to a flame, are not melted into a liquid but maintain the shape of the fibers. The non-melting fibers are those that have a high-temperature shrinkage rate that falls within the range specified herein and have a Young's modulus multiplied by the cross-sectional area of the fibers that falls within the range specified herein. Specific examples thereof include flame-resistant fibers and meta-aramid fibers. Flame-resistant fibers are fibers produced by applying flame-resistant treatment to raw fibers selected from acrylonitrile fibers, pitch fibers, cellulose fibers, phenol fibers and the like. The non-melting fibers may be of a single type or a combination of two or more types. Of the above exemplified fibers, flame-resistant fibers are preferred due to the low shrinkage at high temperature. Of various types of flame-resistant fibers, acrylonitrile-based flame-resistant fibers are preferred because they have a small specific gravity and are soft and excellent in flame-retardant properties. The acrylonitrile-based flame-resistant fibers can be produced by heating and oxidizing acrylic fibers as a precursor in air at high temperature. Examples of commercially available acrylonitrile-based flame-resistant fibers include flame-resistant PYRON (registered trademark) fibers manufactured by Zoltek Corporation, which are used in the Examples and the Comparative Examples described later, and Pyromex manufactured by Toho Tenax Co., Ltd. In general, meta-aramid fibers have high shrinkage at high temperature and do not meet the high-temperature shrinkage rate specified herein. However, meta-aramid fibers can be made suitable by a treatment to reduce the high-temperature shrinking rate to fall within the range specified herein. A too small amount of the non-melting fibers in the flame-blocking nonwoven fabric may not sufficiently function as a structural filler, whereas a too large amount of the non-melting fibers in the flame-blocking nonwoven fabric may not allow the thermoplastic fibers to sufficiently spread over the non-melting fibers like a film. The amount of the non-melting fibers A contained in the flame-blocking nonwoven fabric is preferably 15 to 70% by weight, more preferably 30 to 50% by weight.

Thermoplastic Fibers B

The thermoplastic fibers B have a LOI value that falls within the range specified herein. Specific examples thereof include fibers made from a thermoplastic resin selected from the group consisting of an anisotropic melt-phase forming polyester, a flame-retardant poly(alkylene terephthalate) (e.g., a flame-retardant polyethylene terephthalate, a flame-retardant polybutylene terephthalate and the like), a flame-retardant poly(acrylonitrile-butadiene-styrene), a flame-retardant polysulfone, a poly(ether-ether-ketone), a poly (ether-ketone-ketone), a polyether sulfone, a polyarylate, a polyphenyl sulfone, a polyether imide, a polyamide-imide, and a mixture thereof. The thermoplastic fibers may be of a single type or a combination of two or more types. The thermoplastic fibers B having a glass transition point of 110° C. or less are preferred because such thermoplastic fibers exhibit binder effect at a relatively low temperature and, as a result, the nonwoven fabric has a high apparent density and high strength. Of the above fibers, polyphenylene sulfide fibers (hereinafter also called PPS fibers) are most preferred due to their high LOI value and easy availability.

PPS fibers, which are preferred, are synthetic fibers made from a polymer containing structural units of the formula —($C_6H_4$—S)— as primary structural units. Representative examples of the PPS polymer include polyphenylene sulfide, polyphenylene sulfide sulfone, polyphenylene sulfide ketone, random copolymers and block copolymers thereof, mixtures thereof and the like. A particularly preferred and desirable PPS polymer is polyphenylene sulfide containing, preferably 90 mol % or more of, p-phenylene units of the formula —($C_6H_4$—S)— as primary structural units. In terms of mass %, a desirable polyphenylene sulfide contains, 80% by mass or more of, preferably 90% by mass more of, the p-phenylene units.

PPS fibers, which are preferred, are made into the nonwoven fabric preferably by a papermaking process as described later. The fiber length in the papermaking process is preferably 2 to 38 mm, more preferably 2 to 10 mm. The PPS fibers having a fiber length of 2 to 38 mm are easy to be uniformly dispersed in a stock suspension for papermaking, and exhibit sufficient tensile strength required for wet-laid fibers (wet web) to pass through the subsequent drying step. In terms of the thickness of the PPS fibers, the single fiber fineness is preferably 0.1 to 10 dtex. The PPS fibers having the fineness are easy to be uniformly dispersed in a stock suspension for papermaking, without aggregation.

The PPS fibers are preferably produced by melting a polymer containing the phenylene sulfide structural units at a temperature above the melting point of the polymer, and spinning the molten polymer from a spinneret into fibers. The spun fibers are undrawn PPS fibers, which are not yet subjected to a drawing process. The most part of the undrawn PPS fibers is in an amorphous structure, and when subjected to heat, can serve as a binder to make fibers stick together. Such undrawn fibers, however, have the disadvantage of poor dimensional stability under heat. To overcome this disadvantage, the spun fibers are subjected to a heat-drawing process that orients the fibers and increases the strength and the thermal dimensional stability of the fibers. Such a drawn yarn is commercially available in various types. Commercially available drawn PPS fibers include, for example, "TORCON" (registered trademark) (Toray Industries, Inc.) and "PROCON" (registered trademark) (Toyobo Co., Ltd.).

The undrawn PPS fibers are preferably used in combination with a PPS drawn yarn for better runnability of the sheet at the processing stages in the papermaking process. Needless to say, instead of PPS fibers, other types of drawn and undrawn yarns that satisfy the requirements disclosed herein can be used in combination.

The fusion of the thermoplastic fibers B and the non-melting fibers A refers to joining them together by the following process: the thermoplastic fibers B are heated to a temperature above the melting point of the fibers to temporarily melt, and then cooled, thereby being integrally united with the non-melting fibers A. Fusion of the thermoplastic fibers B and the non-melting fibers A also encompasses bonding them together by applying pressure after the thermoplastic fibers B are softened by, for example, heating them to a temperature exceeding the glass transition point of the thermoplastic fibers B. The thermoplastic fibers B and the non-melting fibers A are preferably fused or pressure-bonded to allow exhibition of binder effect.

Fibers C Used in Addition to Non-Melting Fibers A and Thermoplastic Fibers B

Fibers C may be added to the nonwoven fabric, in addition to the non-melting fibers A and the thermoplastic fibers B, to impart a particular characteristic. For example, fibers having a relatively low glass transition point or softening temperature such as polyethylene terephthalate fibers and vinylon fibers, may be added to increase the strength of the fabric by appropriate heat treatment prior to a thermal pressure bonding step and thereby improve runnability of the fabric at the processing stages. Of such fibers, vinylon fibers are preferred due to their high bonding strength and high flexibility. The amount of the fibers C is not particularly limited as long as the desired effects are not impaired, but is preferably 20% by weight or less, more preferably 10% by weight or less, based on the total weight of the flame-blocking nonwoven fabric.

The mass per unit area and the thickness of the nonwoven fabric are not particularly limited as long as the nonwoven fabric satisfies the density specified herein. The mass per unit area and the thickness are selected as appropriate depending on the desired flame-blocking performance, but are preferably selected from the range specified below so that the nonwoven fabric satisfies the above density range to achieve the balance between ease of handling and the flame-blocking properties. That is, the mass per unit area is preferably 15 to 400 g/m$^2$, more preferably 20 to 200 g/m$^2$. The thickness is preferably 20 to 1000 μm, more preferably 35 to 300 μm.

The nonwoven fabric may be produced by the dry-laid method or the wet-laid method. Bonding of the fibers may be performed by thermal bonding, needle punching, or water jet punching. Alternatively, the thermoplastic fibers may be layered on a web of the non-melting fibers by span bonding or melt blowing. The wet-laid method is preferred to obtain a uniform dispersion of different types of fibers. More preferably, the bonding of the fibers is performed by thermal bonding to increase the density of the nonwoven fabric. Further preferably, fibers with low crystallinity such as an undrawn yarn, are used as part or all of the thermoplastic fibers to improve runnability of the nonwoven fabric in the thermal bonding process and increase the strength of the nonwoven fabric. Preferably, in the nonwoven fabric, part of the PPS fibers is undrawn PPS fibers. The undrawn PPS fibers enhance the fusion and form the nonwoven fabric, and the fusion is selectively present on the surface of the nonwoven fabric. The ratio of the drawn PPS fibers and the undrawn PPS fibers in the nonwoven fabric is preferably 3:1 to 1:3, more preferably 1:1.

The nonwoven fabric can be produced, for example, as follows. The non-melting fibers A, the thermoplastic fibers B, and the optional fibers C are cut into a length of 2 to 10 mm. Then, the fibers are dispersed in water at an appropriate content ratio. The dispersion is filtered on a wire (papermaking wire) to form a web. The web is dried to remove water (the steps so far are included in the papermaking process). The fabric is then heated and pressurized with a calender machine. In the preparation of the fiber dispersion in water, a dispersant and/or a defoaming agent may be added as needed to uniformly disperse the fibers.

The drying process that removes water from the web filtered on a wire may be performed with a paper machine and a dryer part attached to the machine. In the dryer part, the wet web filtered on the wire in the previous step in a paper machine is transferred to a belt, then the web is sandwiched between two belts to squeeze water, and the resulting sheet is dried on a rotary drum. The drying temperature of the rotary drum is preferably 90 to 120° C. The rotary drum at this drying temperature can efficiently remove water, and hardly crystallizes the amorphous components in the thermoplastic fibers B, leading to sufficient fusion of the fibers when subsequently heated and pressurized by a calender machine.

In a preferred production method of the nonwoven fabric, heating and pressurizing treatment is performed with a calender machine following the removal of water. The calender machine may be any one as long as it has one or more pairs of rolls and has heating and pressurizing means. The material of the rolls may be appropriately selected from metals, paper, rubbers and the like. Particularly preferred are metal rolls such as iron rolls to prevent fine lint from forming on the surface of the nonwoven fabric.

EXAMPLES

Our fabrics will be specifically described with reference to Examples, but this disclosure is not limited to these Examples. Various alterations and modifications are possible within the technical scope of the disclosure. The various properties evaluated in the Examples were measured as follows.

Mass Per Unit Area

The mass per unit area was measured in accordance with JIS P 8124 (2011) and expressed in terms of the mass per $m^2$ ($g/m^2$).

Thickness

The thickness was measured in accordance with JIS P 8118 (2014).

Glass Transition Point

The glass transition point was measured in accordance with JIS K 7121 (2012).

LOI Value

The LOI value was measured in accordance with JIS K 7201-2 (2007).

Assessment of Flame-Blocking Properties

The flame-blocking properties were assessed by subjecting a specimen to a flame by a modified method based on the A-1 method (the 45° micro burner method) in JIS L 1091 (Testing methods for flammability of textiles, 1999), as follows. As shown in the FIGURE, a micro burner (1) with a flame of 45 mm in length (L) was placed vertically, then a specimen (2) was held at an angle of 45° relative to the horizontal plane, and a combustible object (4) was mounted above the specimen (2) via spacers (3) of 2 mm in thickness (th) inserted between the specimen and the combustible object. The specimen was subjected to burning to assess the flame-blocking properties. As the combustible object (4), a qualitative filter paper, grade 2 (1002) available from GE Healthcare Japan Corporation was used. Before use, the combustible object (4) was left to stand under standard conditions for 24 hours to make the moisture content uniform throughout the object. In the assessment, the time from ignition of the micro burner (1) to the spread of fire to the combustible object (4) was measured in seconds. When no spread of the fire to the combustible object (4) was observed during 1-minute exposure of the specimen to the flame, there was determined to be "no spread of fire".

The terms used in the following Examples and Comparative Examples will be described below.

Undrawn Yarn of PPS Fibers

"TORCON" (registered trademark), catalog number S111 (Toray Industries, Inc.) having a single fiber fineness of 3.0 dtex (17 μm in diameter) and a cut length of 6 mm was used as undrawn PPS fibers. The PPS fibers had a LOI value of 34 and a glass transition point of 92° C.

Drawn Yarn of PPS Fibers

"TORCON" (registered trademark), catalog number S301 (Toray Industries, Inc.) having a single fiber fineness of 1.0 dtex (10 μm in diameter) and a cut length of 6 mm was used as drawn PPS fibers. The PPS fibers had a LOI value of 34 and a glass transition point of 92° C.

Drawn Yarn of Polyester Fibers

"TETORON" (registered trademark), catalog number T9615 (Toray Industries, Inc.) having a single fiber fineness of 2.2 dtex (14 μm in diameter) was cut into a length of 6 mm and used as drawn polyester fibers. The polyester fibers had a LOI value of 22 and a glass transition point of 72° C.

Paper Machine that Forms Handsheets

A paper machine that forms handsheets (KUMAGAI RIKI KOGYO Co., Ltd.) having a size of 30 cm×30 cm×40 cm in height and being equipped with a wire of 140 mesh to form handsheets at the bottom of the vessel was used.

Rotary Dryer

For drying a handmade sheet, a rotary dryer (ROTARY DRYER DR-200, KUMAGAI RIKI KOGYO Co., Ltd.) was used.

Heating and Pressurization

Heating and pressurization process was performed with a hydraulic three roll calender machine having iron and paper rolls (model: IH type H3RCM, YURI ROLL Co., Ltd.).

Example 1

Flame-resistant PYRON (registered trademark) fibers of 1.7 dtex (Zoltek Corporation) were cut into 6 mm. These flame-resistant fibers, an undrawn yarn of PPS fibers and a drawn yarn of PPS fibers were provided at a ratio by mass of 4:3:3. The high-temperature shrinkage rate of the PYRON fibers was 1.6% and the Young's modulus multiplied by the cross-sectional area of the fibers was 0.98 N. The above three types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 37.3 $g/m^2$ and a thickness of 61 μm, and the density calculated from these was 611 $kg/m^3$. The fabric was thus densely packed, and the fabric had softness and sufficient firmness. The nonwoven fabric produced in Example 1 and the nonwoven fabrics produced in Examples 2 to 4 and Comparative Examples 1 to 3 described later were used as specimens in the flammability test for assessment of flame-blocking properties. In assessment of flame-blocking properties of the nonwoven fabric of this Example, no spread of fire to the combustible object was observed during 1 minute-exposure to the flame, indicating that the fabric had sufficient flame-blocking properties. In assessment of processability in bending, when the nonwoven fabric was bent in 90° or more, no breakage or hole was found, revealing that the fabric had excellent processability in bending.

Example 2

Flame-resistant PYRON (registered trademark) fibers of 1.7 dtex (Zoltek Corporation) were cut into 6 mm. These flame-resistant fibers, an undrawn yarn of PPS fibers and a drawn yarn of PPS fibers were provided at a ratio by mass of 2:4:4. The high-temperature shrinkage rate of the PYRON fibers was 1.6% and the Young's modulus multiplied by the cross-sectional area of the fibers was 0.98 N. The above three types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 40 g/m$^2$ and a thickness of 57 μm, and the density calculated from these was 702 kg/m$^3$. The fabric was thus densely packed, and the fabric had softness and sufficient firmness. In assessment of flame-blocking properties of the nonwoven fabric, no spread of fire to the combustible object was observed during 1 minute-exposure to the flame, indicating that the fabric had flame-blocking properties. However, the combustible object had a larger carbonized area than that of Example 1, and slight afterglow was observed. In assessment of processability in bending, when the nonwoven fabric was bent in 90° or more, no breakage or hole was found, revealing that the fabric had excellent processability in bending.

Example 3

Flame-resistant PYRON (registered trademark) fibers of 1.7 dtex (Zoltek Corporation) were cut into 6 mm. These flame-resistant fibers, an undrawn yarn of PPS fibers and a drawn yarn of PPS fibers were provided at a ratio by mass of 6:2:2. The high-temperature shrinkage rate of the PYRON fibers was 1.6% and the Young's modulus multiplied by the cross-sectional area of the fibers was 0.98 N. The above three types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 39 g/m$^2$ and a thickness of 136 μm, and the density calculated from these was 287 kg/m$^3$, indicating that the fabric was slightly bulky but was industrially acceptable. In assessment of flame-blocking properties of the nonwoven fabric, no spread of fire to the combustible object was observed during 1 minute-exposure to the flame, indicating that the fabric had sufficient flame-blocking properties. However, the combustible object had a larger carbonized area than that of Example 1. In assessment of processability in bending, when the nonwoven fabric was bent in 90° or more, no breakage or hole was found, revealing that the fabric had excellent processability in bending.

Example 4

Flame-resistant PYRON (registered trademark) fibers of 1.7 dtex (Zoltek Corporation) were cut into 6 mm. These flame-resistant fibers, a drawn yarn of polyester fibers (fibers C), an undrawn yarn of PPS fibers and a drawn yarn of PPS fibers were provided at a ratio by mass of 4:1:2:3. The high-temperature shrinkage rate of the PYRON fibers was 1.6% and the Young's modulus multiplied by the cross-sectional area of the fibers was 0.98 N. The above four types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 39 g/m$^2$ and a thickness of 57 μm, and the density calculated from these was 684 kg/m$^3$. The fabric was thus densely packed, and the fabric had softness and sufficient firmness. In assessment of flame-blocking properties, fire burning on the surface of the specimen was observed for a moment just after ignition of the burner, but the fire self-extinguished immediately and no spread of fire to the combustible object was observed during 1 minute-exposure to the flame, indicating that the fabric had sufficient flame-blocking properties. In assessment of processability in bending, when the nonwoven fabric was bent in 90° or more, no breakage or hole was found, revealing that the fabric had excellent processability in bending.

Comparative Example 1

Meta-aramid fibers of 1.67 dtex were cut into 6 mm. These meta-aramid fibers, an undrawn yarn of PPS fibers and a drawn yarn of PPS fibers were provided at a ratio by mass of 4:3:3. The high-temperature shrinkage rate of the meta-aramid fibers was 5.0% and the Young's modulus multiplied by the cross-sectional area of the fibers was 1.09 N. The above three types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 38 g/m$^2$ and a thickness of 62 μm, and the density calculated from these was 613 kg/m$^3$. The fabric was thus densely packed, and the fabric had softness and sufficient firmness. In assessment of flame-blocking properties, however, a burn hole was created on the surface of the specimen just above the burner within less than 5 seconds after ignition of the burner, and the fire spread over the combustible object, indicating that the fabric had no flame-blocking properties. In assessment of processability in bending, when the nonwoven fabric was bent in 90° or more, no breakage or hole was found, revealing that the fabric had excellent processability in bending.

Comparative Example 2

Flame-resistant PYRON (registered trademark) fibers of 1.7 dtex (Zoltek Corporation) were cut into 6 mm. These flame-resistant fibers and a drawn yarn of polyester fibers were provided at a ratio by mass of 4:6. The high-temperature shrinkage rate of the PYRON fibers was 1.6% and the Young's modulus multiplied by the cross-sectional area of the fibers was 0.98 N. The above two types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 170° C., at a linear pressure of 490 N/cm, and at a roll rotational speed of 5 m/min so that each face of the sheet was heated and pressurized once. Thus, a nonwoven fabric was produced. The nonwoven fabric had a mass per area of 37 g/m$^2$ and a thickness of 61 μm, and the density calculated from these was 606 kg/m$^3$. The fabric was thus densely packed, and the fabric had softness and sufficient firmness. In assessment of flame-blocking properties, however, the specimen caught fire within less than one second after ignition of the burner, indicating that the fabric had no flame-blocking properties. In assessment of processability in bending, when the nonwoven fabric was bent in 90° or more, no breakage or hole was found, revealing that the fabric had excellent processability in bending.

Comparative Example 3

PAN carbon fibers having a single fiber diameter of 7 μm were cut into 6 mm. These PAN carbon fibers, an undrawn yarn of PPS fibers and a drawn yarn of PPS fibers were provided at a ratio by mass of 4:3:3. The high-temperature shrinkage rate of the carbon fibers was 0% and the Young's modulus multiplied by the cross-sectional area of the fibers was 9.04 N. The above three types of fibers were dispersed in water, and the dispersion filtered on the wire of a paper machine to form handsheets to give a wet web. The wet web was dried by heating with a rotary dryer at 110° C. for 70 seconds, and the resulting sheet passed twice through rolls at an iron roll surface temperature of 200° C., at a linear pressure of 490 N/cm, and at a roll rotational speed of 5 m/min so that each face of the sheet was heated and pressurized once. Thus, a nonwoven fabric was produced. The nonwoven fabric had a mass per area of 39 g/m$^2$ and a thickness of 95 μm, and the density calculated from these was 410 kg/m$^3$. In assessment of flame-blocking properties, no spread of fire to the combustible object was observed during 1 minute-exposure to the flame, indicating that the fabric had sufficient flame-blocking properties. In assessment of processability in bending, however, when the nonwoven fabric was bent in 90° or more, the carbon fibers at the bent corner broke and several holes were developed. Thus, the fabric was difficult to handle, and could not be processed in bending.

The results of the assessment of flame-blocking properties and processability in bending of Examples 1 to 4 and Comparative Examples 1 to 3 are summarized in Table 1 below.

TABLE 1

| | Flame-blocking properties | Processability in bending |
|---|---|---|
| Example 1 | Yes | Yes |
| Example 2 | Yes | Yes |
| Example 3 | Yes | Yes |
| Example 4 | Yes | Yes |
| Comparative Example 1 | No | Yes |
| Comparative Example 2 | No | Yes |
| Comparative Example 3 | Yes | No |

INDUSTRIAL APPLICABILITY

Our fabrics are effective in preventing a fire from spreading, and are thus suitable as a wall material, a flooring material, a ceiling material and the like that are required to have flame-retardant properties.

The invention claimed is:

1. A flame-blocking nonwoven fabric having a density of 200 kg/m3 or more and comprising fibers A having a high-temperature shrinkage rate of 3% or less and a Young's modulus multiplied by a cross-sectional area of the fibers of 2.0 N or less, and selected from flame-resistant fibers and meta-aramid fibers, and polyphenylene sulfide fibers having a LOI value of 25 or more as determined according to JIS K 7201-2 (2007), wherein the flame-resistant fibers are acrylonitrile produced by heating and oxidizing acrylic fibers and the polyphenylene sulfide fibers comprise drawn polyphenylene sulfide fibers and undrawn polyphenylene sulfide fibers, wherein the undrawn polyphenylene sulfide fibers are fused with the fibers A, and part of the fused undrawn polyphenylene sulfide fibers is present on a surface of the nonwoven fabric.

2. The flame-blocking nonwoven fabric according to claim 1, wherein an amount of the fibers A contained in the fabric is 15 to 70% by weight.

3. The flame-blocking nonwoven fabric according to claim 1, further comprising 20% by weight or less of fibers C based on the total weight of the flame-blocking nonwoven fabric in addition to the fibers A and the polyphenylene sulfide fibers.

4. The flame-blocking nonwoven fabric according to claim 1, wherein the ratio of the drawn polyphenylene sulfide fibers and the undrawn polyphenylene sulfide fibers is 3:1 to 1:3 by weight.

5. The flame-blocking nonwoven fabric according to claim 4, wherein the ratio of the drawn polyphenylene sulfide fibers and the undrawn polyphenylene sulfide fibers is 1:1.

* * * * *